US012232611B2

(12) United States Patent
Wu

(10) Patent No.: US 12,232,611 B2
(45) Date of Patent: Feb. 25, 2025

(54) LIFTING STORAGE MECHANISM

(71) Applicant: Dongguan Yongsheng Spring Co., Ltd., Dongguan (CN)

(72) Inventor: Lilin Wu, Dongguan (CN)

( * ) Notice: Subject to any disclaimer, the term of this patent is extended or adjusted under 35 U.S.C. 154(b) by 9 days.

(21) Appl. No.: 18/107,469

(22) Filed: Feb. 8, 2023

(65) Prior Publication Data

US 2024/0115041 A1 Apr. 11, 2024

(30) Foreign Application Priority Data

Oct. 9, 2022 (CN) ..... 202222639820.8

(51) Int. Cl.

| | |
|---|---|
| ***A47B 57/06*** | (2006.01) |
| ***A47B 51/00*** | (2006.01) |
| ***A47B 96/02*** | (2006.01) |
| *A47F 1/06* | (2006.01) |
| *A47F 5/16* | (2006.01) |

(52) U.S. Cl.

CPC ..... *A47B 51/00* (2013.01); *A47B 57/06* (2013.01); *A47B 96/025* (2013.01); *A47F 1/06* (2013.01); *A47F 5/16* (2013.01)

(58) Field of Classification Search

CPC ..... A47B 51/00; A47B 96/025; A47B 57/06; A47B 77/04; A47B 9/02; A47B 9/12; F25D 25/04; F25D 25/025; F25D 25/02; A47F 5/0081; A47F 5/16

See application file for complete search history.

(56) References Cited

U.S. PATENT DOCUMENTS

| | | | | |
|---|---|---|---|---|
| 5,715,759 A * | 2/1998 | Lee | A47B 51/00 108/147 |
| 10,234,195 B2 * | 3/2019 | Yasaka | F25D 25/025 |
| 2016/0367023 A1 * | 12/2016 | Toedtman | A47B 9/02 |
| 2018/0128540 A1 * | 5/2018 | Yasaka | B66F 7/02 |

(Continued)

FOREIGN PATENT DOCUMENTS

| | | | |
|---|---|---|---|
| CN | 216651896 U * | 6/2022 | |
| KR | 20110002969 A * | 1/2011 | A47B 77/04 |

*Primary Examiner* — Kimberley S Wright

(57) ABSTRACT

This utility model relates to the technical field of shelves, in particular to a lifting storage mechanism. The lifting storage mechanism includes a frame body, a lifting platform, a guiding assembly and a resetting assembly, wherein the guiding assembly is provided with a first sliding structure, a second sliding structure and a third sliding structure, which are respectively connected to the resetting assembly and the lifting platform to cooperate with the resetting assembly and drive the lifting platform to go up and down in the accommodating cavity. The lifting storage mechanism disclosed by the utility model is simple in structure and reasonable in design. During use, when articles on the lifting platform are gradually taken away, the lifting platform is lifted up along with three groups of sliding structures under the action of pulling force of the resetting assembly. In a lifting process, the three groups of the sliding structures can achieve the effects of guidance, limitation and stable support so that the lifting platform is stressed more uniformly to prevent the situations of inclination and the like, and ensure that the lifting process is smoother and more stable to meet lifting requirements well.

8 Claims, 7 Drawing Sheets

(56) References Cited

U.S. PATENT DOCUMENTS

| | | | | |
|---|---|---|---|---|
| 2022/0400849 | A1* | 12/2022 | Williams | A47B 57/08 |
| 2023/0099221 | A1* | 3/2023 | Sellars | A47B 51/00<br>414/800 |

* cited by examiner

LIFTING STORAGE MECHANISM

TECHNICAL FIELD

The utility model relates to the technical field of shelves, and in particular to a lifting storage mechanism.

BACKGROUND

As the types of shelves are becoming more and more automatic and intelligent, lifting shelves are widely applied to display and sale of goods, so that placement and sale of the goods are greatly facilitated.

However, due to the defects in structural design of existing lifting shelves, it is easy to cause the shelves to incline and the goods to tip over in the use process. For example, in the Chinese patent CN202123359080.4: lifting shelf, guidance and limitation are provided in two directions by arranging two groups of roller assemblies. However, for the goods with unbalanced gravity on two sides, it is easy to incline, resulting in inconvenient use.

SUMMARY

In order to solve the problems, the utility model provides a lifting storage mechanism, which is simple in structure, reasonable in design, stable to lift and convenient to use.

The utility model adopts the following technical solution:

a lifting storage mechanism includes a frame body, a lifting platform, a guiding assembly and a resetting assembly;

an accommodating cavity is formed in the frame body;

the lifting platform is located in the accommodating cavity; the resetting assembly is mounted on the frame body; and the guiding assembly is provided with a first sliding structure, a second sliding structure and a third sliding structure, where the first sliding structure, the second sliding structure and the third sliding structure are arranged on one surface of the inner side of the frame body at intervals, and are respectively connected to the resetting assembly and the lifting platform to cooperate with the resetting assembly and drive the lifting platform to go up and down in the accommodating cavity.

Further, the frame body is provided with a first sliding groove, a second sliding groove and a third sliding groove;

the first sliding groove and the second sliding groove are located at two sides of the rear end surface of the inner side of the frame body, and the third sliding groove is located at the middle position of the rear end surface of the inner side of the frame body; and the first sliding structure is arranged in the first sliding groove in a sliding manner, the second sliding structure is arranged in the second sliding groove in a sliding manner, and the third sliding structure is arranged in the third sliding groove in a sliding manner.

Further, the first sliding structure is provided with a first roller, the second sliding structure is provided with a second roller, the third sliding structure is provided with a third roller, the sliding directions of the first roller and the second roller are set to be consistent, and the sliding directions of the first roller and the third roller are set to be perpendicular to each other.

Further, the first sliding structure is further provided with a first fixing frame, the second sliding structure is further provided with a second fixing frame, and the third sliding structure is provided with a third fixing frame;

the first fixing frame, the second fixing frame and the third fixing frame are located at the bottom end of the lifting platform at intervals, and are respectively connected to the lifting platform so as to support the lifting platform; and the first roller is mounted on the first fixing frame, the second roller is mounted on the second fixing frame, and the third roller is mounted on the third fixing frame.

Further, the third fixing frame includes a support plate and a U-shaped frame;

the top end of the support plate is connected to the lifting platform, and the left side and the right side of the support plate are respectively connected to the first fixing frame and the second fixing frame; and the U-shaped frame is respectively connected to the support plate and the resetting assembly.

Further, the resetting assembly includes a first resetting structure and a second resetting structure, wherein the first resetting structure and the second resetting structure are respectively arranged on two sides of the U-shaped frame, and are connected to the U-shaped frame;

one end, away from the U-shaped frame, of the first resetting structure is connected to the first fixing frame; and one end, away from the U-shaped frame, of the second resetting structure is connected to the second fixing frame.

Further, the first resetting structure is provided with a first reel and several first coil springs, where two ends of the first reel are respectively connected to the first sliding structure and the first fixing frame, one end of each of several first coil springs is mounted on the frame body, and the other end of each of several first coil springs is arranged on the first reel; and the second resetting structure is provided with a second reel and several second coil springs, where two ends of the second reel are respectively connected to the second sliding structure and the second fixing frame, one end of each of several second coil springs is mounted on the frame body, and the other end of each of several coil springs is arranged on the second reel.

Further, a protection plate is arranged on the outer side of the frame body. Further, a baffle is arranged at the top end of the frame body.

The utility model has the following beneficial effects:

the lifting storage mechanism includes a frame body, a lifting platform, a guiding assembly and a resetting assembly, where the guiding assembly is provided with a first sliding structure, a second sliding structure and a third sliding structure which are respectively connected to the resetting assembly and the lifting platform to cooperate with the resetting assembly and drive the lifting platform to go up and down in the accommodating cavity. The lifting storage mechanism disclosed by the utility model is simple in structure and reasonable in design. During use, when articles on the lifting platform are gradually taken away, the lifting platform is lifted up along with three groups of sliding structures under the action of pulling force of the resetting assembly. In the lifting process, the three groups of the sliding structures can achieve the effects of guidance, limitation and stable support, so that the lifting platform is stressed more uniformly to prevent the situations of inclination and the like, and ensure that the lifting process is smoother and more stable to meet lifting use requirement well.

Figure 1:
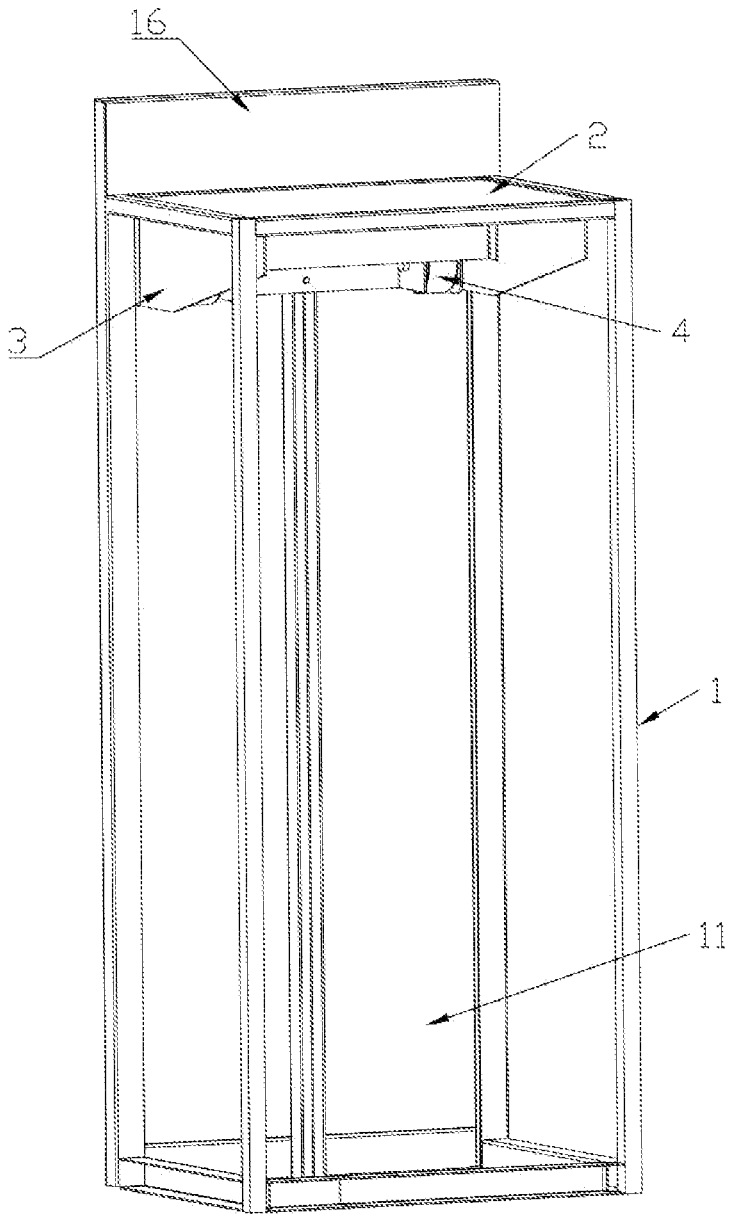
FIG. 1 is a structural schematic diagram according to some embodiments of the application.
Figure 2:
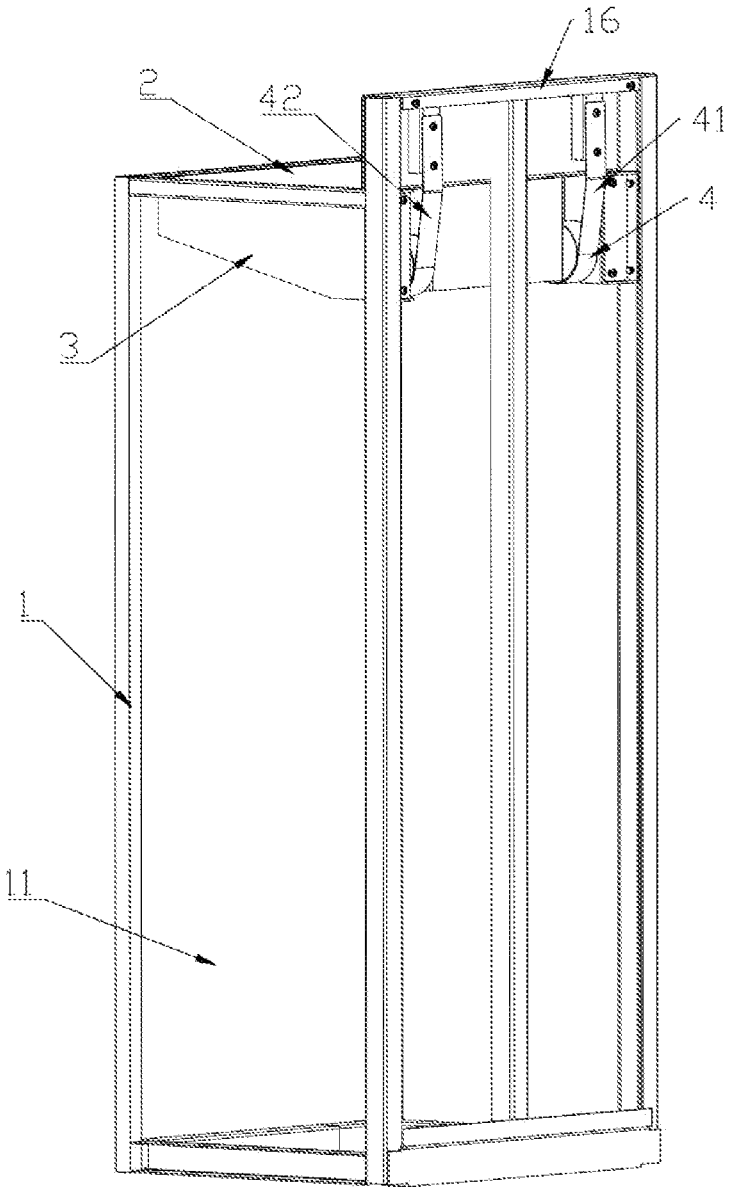
FIG. 2 is a structural schematic diagram in another perspective of FIG. 1.
Figure 3:
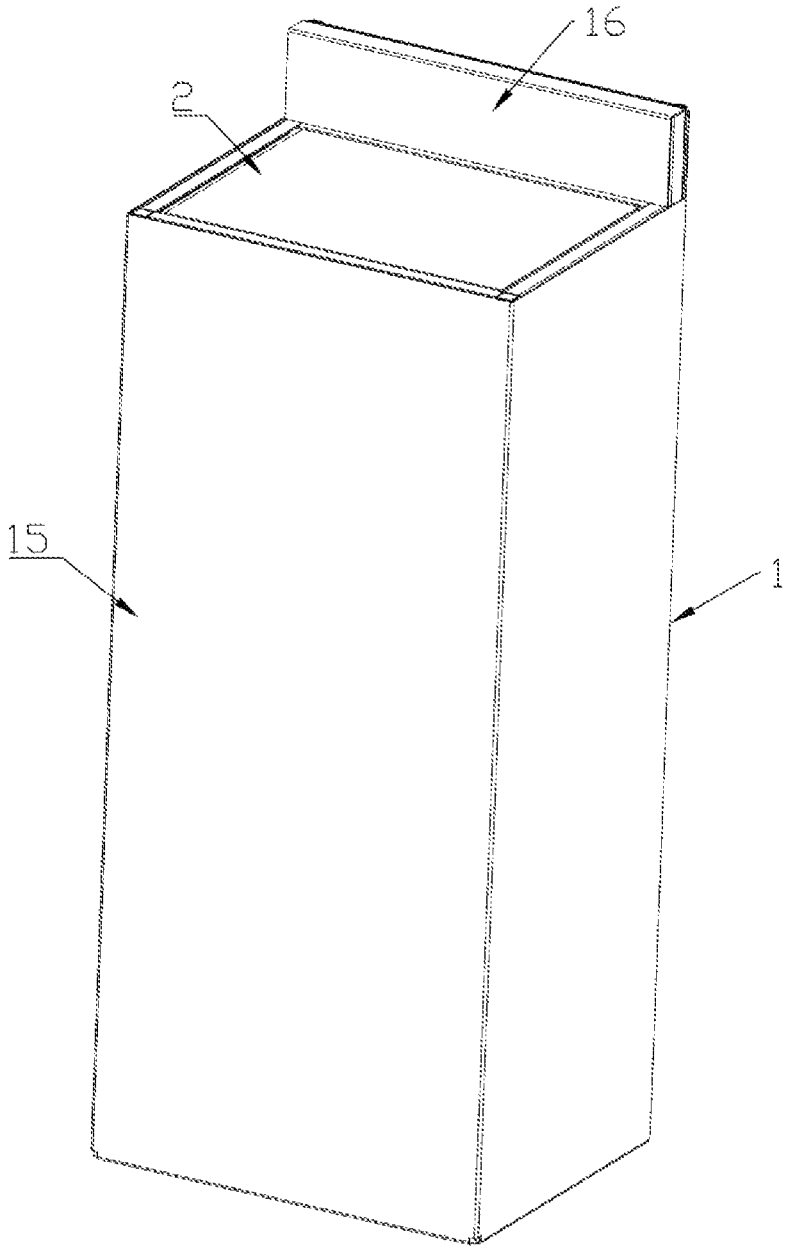
FIG. 3 is a structural schematic diagram according to some embodiments of the application.

DESCRIPTION OF REFERENCE NUMERALS frame body 1, accommodating cavity 11, first sliding groove 12, second sliding groove 13, third sliding groove 14, protection plate 15, baffle 16, lifting platform 2, guiding assembly 3, first sliding structure 31, second sliding structure 32, third sliding structure 33, resetting assembly 4, first resetting structure 41, second resetting structure 42, first roller 311, second roller 321, third roller 331, first fixing frame 312, second fixing frame 322, third fixing frame 332.

DETAILED DESCRIPTION OF THE EMBODIMENTS

The technical solutions of the utility model are described below clearly and completely with reference to the accompanying drawings. Apparently, the described embodiments are some rather than all the embodiments of the utility model. All other embodiments obtained by a person of ordinary skill in the art based on the embodiments of the utility model without inventive efforts fall within the scope of protection of the utility model.

In the description of the utility model, it should be noted that orientation or position relationships indicated by terms such as "center", "upper", "lower", "left", "right", "vertical", "horizontal", "inner", "outer" and the like are the orientation or position relationships as shown in the drawings, and these terms are just used to facilitate description of the utility model and simplify the description, but not to indicate or imply that the mentioned device or elements must have a specific orientation and must be established and operated in a specific orientation, and thus, these terms cannot be understood as a limitation to the utility model. In addition, the terms "first", "second" and "third" are only used for the purpose of description and cannot be understood as indicating or implying relative importance.

In the description of the utility model, it should be noted that unless otherwise specified and limited, the terms "mounting", "connected" and "connection" should be understood in a broad sense, for example, they may be fixed connection, detachable connection or integrated connection; they may be mechanical connection or electrical connection; and they may be direct connection or indirect connection through an intermediate medium, or internal communication of two components. For a person of ordinary skill in the art, the specific meaning of the terms in the utility model can be understood in specific cases.

As shown in FIG. 1 to FIG. 7, the lifting storage mechanism disclosed by the utility model includes a frame body 1, a lifting platform 2, a guiding assembly 3 and a resetting assembly 4;

an accommodating cavity 11 is arranged in the frame body 1;

the lifting platform 2 is located in the accommodating cavity 11 the resetting assembly 4 is mounted on the frame body 1; and the guiding assembly 3 is provided with a first sliding structure 31, a second sliding structure 32 and a third sliding structure 33, where the first sliding structure 31, the second sliding structure 32 and the third sliding structure 33 are arranged on one surface of the inner side of the frame body 1 at intervals and are respectively connected to the resetting assembly 4 and the lifting platform 2 to cooperate with the resetting assembly 4 and drive the lifting platform 2 to go up and down in an accommodating cavity 11.

The lifting storage mechanism according to the embodiments is simple in structure and reasonable in design. During use, when articles on the lifting platform 2 are gradually taken away, the lifting platform 2 is lifted up along with three groups of sliding structures under the pulling force of the resetting assembly 4. In the lifting process, the three groups of the sliding structures can achieve the effects of guidance, limitation and stable support, so that the lifting platform 2 is stressed more uniformly to prevent the situations of inclination and the like, and ensure that the lifting process is smoother and more stable to meet lifting use requirement well.

Figure 4:
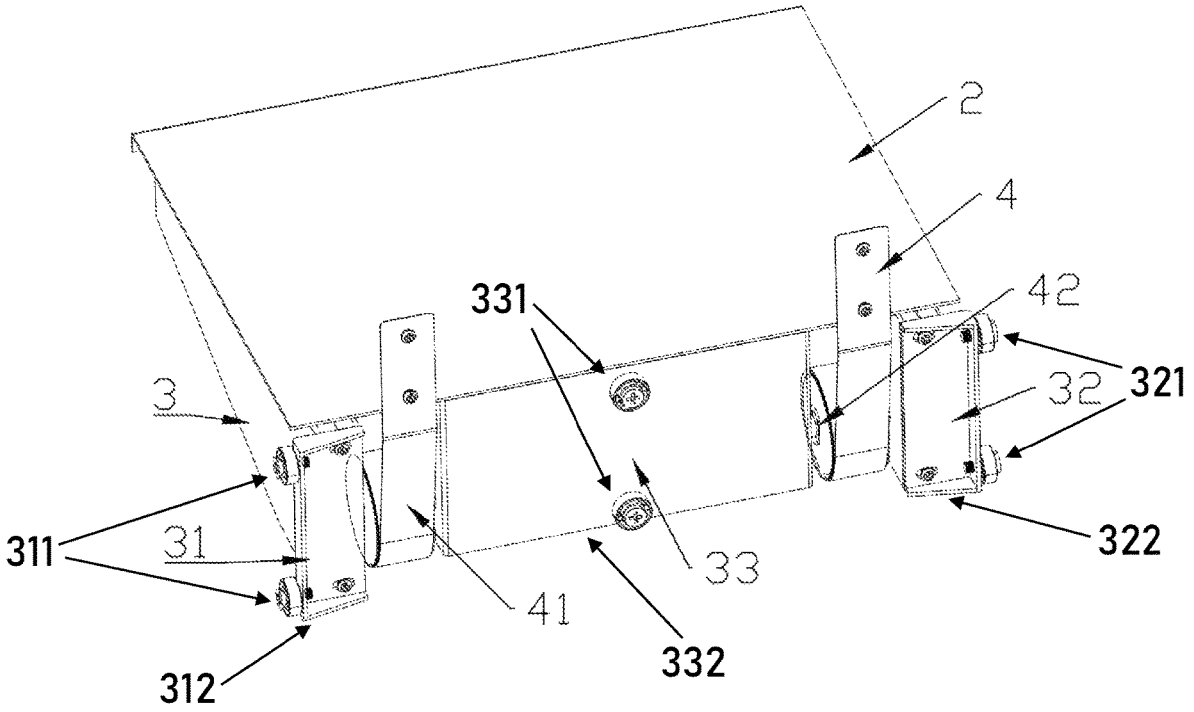
FIG. 4 is a schematic diagram of a connection structure of a lifting platform, a guiding assembly and a resetting assembly according to some embodiments of the application.
Figure 5:
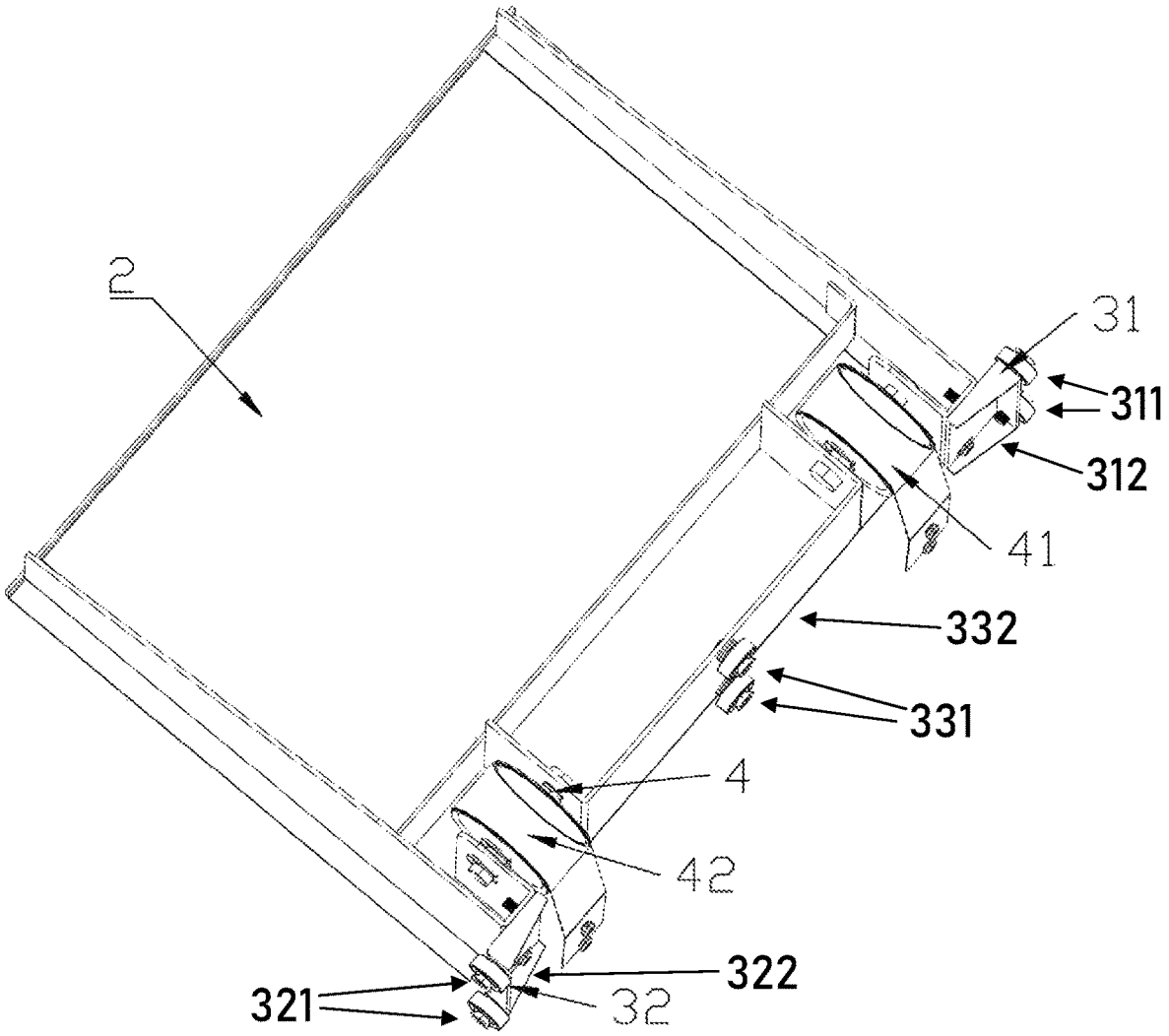
FIG. 5 is a structural schematic diagram in another perspective of FIG. 4.
Figure 6:
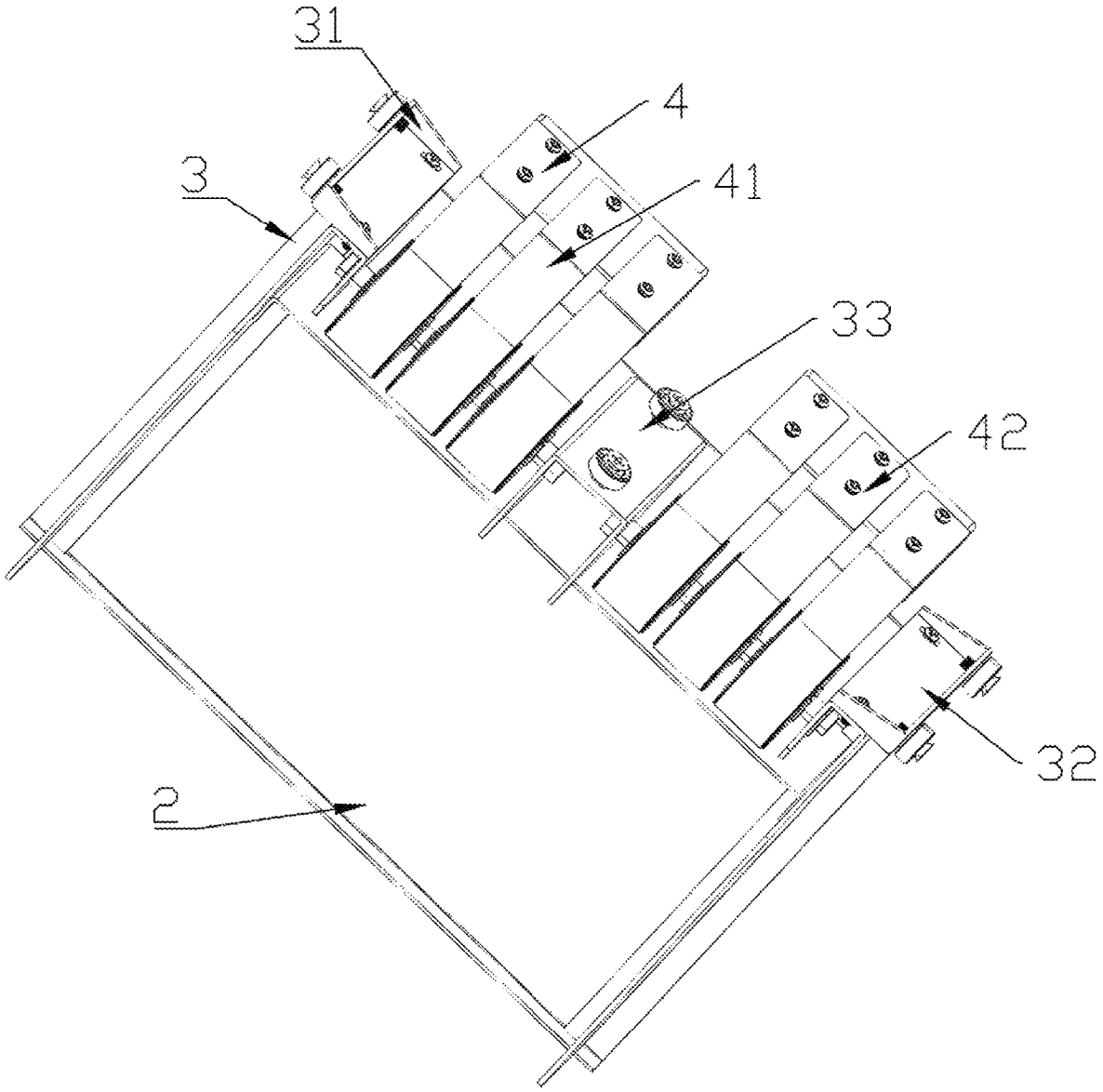
FIG. 6 is a schematic diagram of a connection structure of a lifting platform, a guiding assembly and a resetting assembly according to some embodiments of the application.
Figure 7:
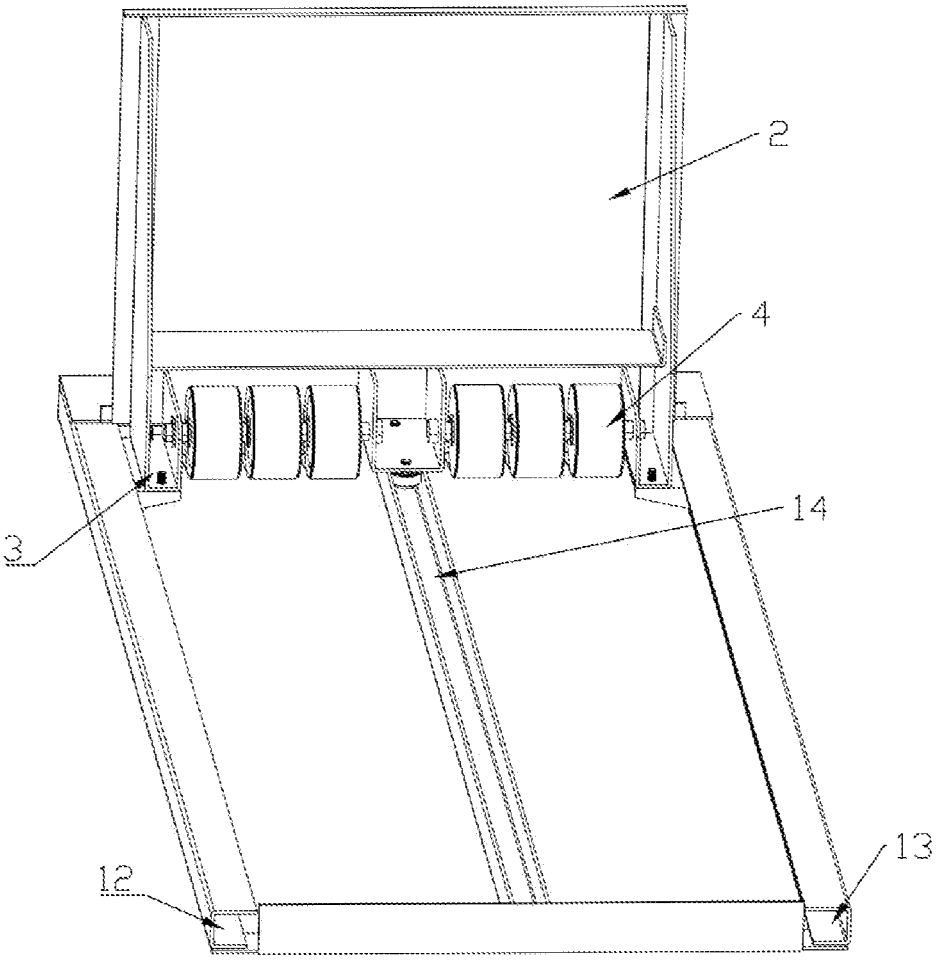
FIG. 7 is a structural schematic diagram of an interior of a frame body according to some embodiments of the application.

Specifically, in the embodiments, the three groups of the sliding structures are distributed on the same surface of the frame body 1 at intervals and are connected to the lifting platform 2; in the lifting process, the three groups of sliding structures are supported synchronously, and one group of the sliding structures at the middle position achieves the effects of guiding and balancing so as to effectively prevent the two groups of good sliding structures on two sides from being different in heights, so as to achieve a stable and smooth lifting. As shown in FIG. 4 to FIG. 6, preferably, the three groups of the sliding structures may be arranged on two sides of the rear end surface of the frame body 1 and at the middle position to achieve better support, and more convenient structure setting.

In some embodiments, the frame body 1 is provided with a first sliding groove 12, a second sliding groove 13 and a third sliding groove 14;

the first sliding groove 12 and the second sliding groove 13 are located at two sides of the rear end surface of the inner side of the frame body 1, and the third sliding groove 14 is located at the middle position of the rear end surface of the inner side of the frame body 1; and the first sliding structure 31 is arranged in the first sliding groove 12 in a sliding manner, the second sliding structure 32 is arranged in the second sliding groove 13 in a sliding manner, and the third sliding structure 33 is arranged in the third sliding groove in a sliding manner 14.

In the embodiments, by corresponding to the three groups of the sliding structures and arranging the three groups of sliding grooves, stable sliding connection can be achieved, and the mechanism is simple in structure and good in sliding and limiting effects.

Specially, the first sliding structure 31 is provided with a first roller, the second sliding structure 32 is provided with a second roller, the third sliding structure 33 is provided with a third roller, the sliding directions of the first roller and the second roller are set to be consistent, and the sliding directions of the first roller and the third roller are set to be perpendicular to each other.

In this embodiment, it specifically shows that the sliding structure is a roller, the sliding directions of the rollers on two sides are consistent, and the sliding direction of the roller at the middle position is perpendicular to those of the rollers on two sides. In this embodiment, through such arrangement, in the lifting process, the three groups of the rollers may provide guiding and limiting functions in two directions, thereby further ensuring that the lifting process of the lifting platform 2 is stable and smooth.

In some embodiments, the first sliding structure 31 is further provided with a first fixing frame, the second sliding structure 32 is further provided with a second fixing frame, and the third sliding structure 33 is provided with a third fixing frame;

the first fixing frame, the second fixing frame and the third fixing frame are located at the bottom end of the lifting platform 2 at intervals, and are respectively connected to the lifting platform 2 so as to support the lifting platform 2; and the first roller is mounted on the first fixing frame, the second roller is mounted on the second fixing frame, and the third sliding structure is mounted on the third fixing frame.

In this embodiment, it specifically shows that the three groups of sliding structures are connected to the resetting assembly 4 and the lifting platform 2 respectively by setting the fixing frames. The lifting storage mechanism is simple in structure, stable to connect and high in support strength, and can well meet the use requirement.

Specially, the third fixing frame includes a support plate and a U-shaped frame; the top end of the support plate is connected to the lifting platform 2, and the left side and the right side of the support plate are respectively connected to the first fixing frame and the second fixing frame; and the U-shaped frame is connected to the support plate and the resetting assembly 4.

In this embodiment, the structural setting of the third fixing frame is specifically shown, where the support plate can achieve the effect of supporting and reinforcing ribs, and also support the middle position of the lifting platform 2, so that the supporting effect is better; and the U-shaped frame is set to be convenient for mounting of the resetting assembly 4, and the mechanism is simple in structure and convenient to use.

In some embodiments, the resetting assembly 4 includes a first resetting structure 41 and a second resetting structure 42;

the first resetting structure 41 and the second resetting structure 42 are respectively arranged on two sides of the U-shaped frame, and are connected to the U-shaped frame;

one end, away from the U-shaped frame, of the first resetting structure 41 is connected to the first fixing frame; and one end, away from the U-shaped frame, of the second resetting structure 42 is connected to the second fixing frame.

Specially, the first resetting structure 41 is provided with a first reel and several first coil springs, where two ends of the first reel are connected to the first sliding structure 31 and the first fixing frame, one end of each of several first coil springs are mounted on the frame body 1, and the other end of each of several first coil springs is arranged on the reel; and the second resetting structure 42 is provided with a second reel and several second coil springs, where two ends of the second reel are connected to the second sliding structure 32 and the second fixing frame, one end of each of several second coil springs is mounted on the frame body 1, and the other end of each of several second coil springs is arranged on the second reel.

This embodiment specifically shows the structural arrangement of the resetting assembly 4. Two groups of coil spring resetting structures are provided, and are distributed and mounted coaxially, so that a stable lifting resetting force can be provided. The resetting assembly is simple in structure, uniform in pulling force and strong in pulling force, can be better suitable for the stable lifting of heavier articles. A plurality of the coil springs may be provided. Referring to FIG. 4 to FIG. 5, a single coil spring is provided. Referring to FIG. 6, three coil springs are arranged on one side, the number of the coil springs may be flexibly set according to the weight of the placed articles, which is not limited herein.

In some embodiments, the protection plate 15 is arranged on the outer side of the frame body 1. In this embodiment, the protection plate 15 is provided to achieve the effects of protection and enable appearance to be beautiful. The protection plate can cooperate with the frame body 1 to form a closed accommodating cavity 11 for storage of the articles, and is highly practical.

In some embodiments, the baffle 16 is arranged at the top end of the frame body 1. In this embodiment, by arranging the baffle 16, when the lifting platform 2 rises to the top end of the frame body 1, the baffle 16 can limit the articles placed on the lifting platform 2 to prevent the articles from falling. The mechanism disclosed by this embodiment has a simple structure and strong practicability.

The above embodiments are merely illustrative of several implementations of the utility model, and the description thereof is more specific and detailed. However, these embodiments may not be construed as a limitation to the patentable scope of the utility model. It should be pointed out that several variations and improvements may be made by those of ordinary skill in the art without departing from the conception of the utility model, but such variations and improvements should fall within the protection scope of the utility model. Therefore, the patent protection scope of the utility model should be subject to the appended claims.

What is claimed is:

1. A lifting storage mechanism, comprising a frame body, a lifting platform, a guiding assembly and a resetting assembly, wherein an accommodating cavity, a first sliding groove, a second sliding groove, and a third sliding groove are formed in the frame body;

the lifting platform is located in the accommodating cavity;

the guiding assembly is provided with a first sliding structure with a first roller and a first fixing frame, a second sliding structure with a second roller and a second fixing frame, and a third sliding structure with a third roller and a third fixing frame comprising a support plate and a U-shaped frame, the first sliding structure, the second sliding structure and the third sliding structure being arranged on one surface of the inner side of the frame body at intervals, and being respectively connected to the resetting assembly and the lifting platform to cooperate with the resetting assembly and drive the lifting platform to go up and down in the accommodating cavity; and the resetting assembly is mounted on the frame body and comprises a first resetting structure and a second resetting structure, the first resetting structure being provided with a first reel and several first coil springs, two ends of the first reel being respectively connected to the first sliding structure and the first fixing frame, one end of each of several first coil springs being mounted on the frame body, and the other end of each of several first coil springs being arranged on the first reel, the second resetting structure is provided with a second reel and several second coil springs, two ends of the second reel being respectively connected to the second sliding structure and the second fixing frame, one end of each of several second coil springs being mounted on the frame body, and the other end of each of several coil springs being arranged on the second reel.

2. The lifting storage mechanism of claim 1, wherein the first sliding groove and the second sliding groove are located at two sides of the rear end surface of the inner side of the frame body, and the third sliding groove is located at the middle position of the rear end surface of the inner side of the frame body; and the first sliding structure is arranged in the first sliding groove in a sliding manner, the second sliding structure is arranged in the second sliding groove in a sliding manner, and the third sliding structure is arranged in the third sliding groove in a sliding manner.

3. The lifting storage mechanism of claim 2, wherein the sliding directions of the first roller and the second roller are set to be consistent, and the sliding directions of the first roller and the third roller are set to be perpendicular to each other.

4. The lifting storage mechanism of claim 3, wherein the first fixing frame, the second fixing frame and the third fixing frame are located at the bottom end of the lifting platform at intervals, and are respectively connected to the lifting platform so as to support the lifting platform; and the first roller is mounted on the first fixing frame, the second roller is mounted on the second fixing frame, and the roller is mounted on the third fixing frame.

5. The lifting storage mechanism of claim 4, wherein the top end of the support plate is connected to the lifting platform, and the left side and the right side of the support plate are respectively connected to the first fixing frame and the second fixing frame; and the U-shaped frame is respectively connected to the support plate and the resetting assembly.

6. The lifting storage mechanism of claim 5, wherein the first resetting structure and the second resetting structure are respectively arranged on two sides of the U-shaped frame, and are connected to the U-shaped frame;

one end, away from the U-shaped frame, of the first resetting structure is connected to the first fixing frame; and one end, away from the U-shaped frame, of the second resetting structure is connected to the second fixing frame.

7. The lifting storage mechanism of claim 1, wherein a protection plate is arranged on the outer side of the frame body.

8. The lifting storage mechanism of claim 1, wherein a baffle is arranged at the top end of the frame body.

* * * * *